US005218738A

United States Patent [19]

Krajenke

[11] Patent Number: 5,218,738

[45] Date of Patent: Jun. 15, 1993

[54] RESILIENT VEHICLE DOOR HOLD

[75] Inventor: Gary W. Krajenke, Warren, Mich.

[73] Assignee: General Motors Corporation, Detroit, Mich.

[21] Appl. No.: 864,288

[22] Filed: Apr. 6, 1992

[51] Int. Cl.[5] ..... E05D 11/00

[52] U.S. Cl. ..... 16/334; 16/335

[58] Field of Search ..... 16/334, 335, 341, 342, 16/377, 338

[56] References Cited

U.S. PATENT DOCUMENTS

| | | | |
|---|---|---|---|
| 3,965,531 | 6/1976 | Fox et al. | 16/338 |
| 4,266,321 | 5/1981 | Pelchat et al. | 16/335 |
| 4,672,715 | 6/1987 | Beckwith | 16/334 |
| 4,800,624 | 1/1989 | Whitefoot et al. | 16/335 |
| 5,074,010 | 12/1991 | Gignal et al. | 16/334 |

*Primary Examiner*—W. Donald Bray
*Attorney, Agent, or Firm*—Raymond I. Bruttomesso, Jr.

[57] ABSTRACT

A hinge assembly rotatably mounts a vehicle door to a vehicle body structure. The hinge assembly has a movable hinge strap mounted to the vehicle door. A stationary hinge strap is mounted to the vehicle body structure and has a roller assembly. A hinge pin pivotally connects the hinge straps for rotatable movement of the door between an open position and a closed position. A curved detent link is carried by the movable hinge strap and has a pair of ends with each end having a hole. The detent link has a scalloped engagement edge with indentations. The indentations are engageable with the roller assembly for positioning the door in the open position and the closed position. Elastomeric fillers located in each hole connect each of the ends of the detent link to the movable hinge strap for allowing lateral movement of the detent link. The engagement of the closed position indentation of the scalloped engagement edge of the detent link by the roller holds the door in the closed position and the elastomeric fillers flex allowing movement of the detent link relative to the roller for moving the door to the open position where the roller is engaged by the open position indentation.

6 Claims, 2 Drawing Sheets

RESILIENT VEHICLE DOOR HOLD

BACKGROUND OF THE INVENTION

Field of the Invention

This invention relates to a door hinge and more particularly to a door hinge having a detent link slideably engageable with a roller assembly for holding the door open where the detent link is secured at both ends by elastomeric filler allowing for resilient movement of the detent link.

It is known to have a detent mechanism for retaining the door in the open position. It is known that the detent mechanism can be incorporated as part of the door hinge where a detent link is pivotably mounted to a movable hinge strap and is biased by a compression spring into engagement with a roller assembly located on the stationary hinge strap. The detent link slideably follows the roller as the movable hinge strap pivots relative to the stationary hinge strap and an indentation on the detent link reaches the roller as the door reaches the open position. The spring, which biases the detent link towards the roller, retains the indentation against the roller holding the door in the open position.

It is also known that the spring in this type of detent mechanism remains in compression when the door is in the open position with the indentation of the detent link engaging the roller. This compression of the spring is required in order to ensure retainment of the spring. Further, if the hinge pin is removed, allowing the removal of the door from the vehicle body, the detent link is not restrained by the roller and continues to pivot because of the bias of the spring. This may result in the spring not being retained. In addition, when the hinge pin is reinstalled, the detent link must be held with the spring compressed to position the hinge straps.

It would be desirable to have a detent link which is retained by the hinge strap at both ends and the detent link is biased into engagement with the roller by resilient elastomeric fillers.

SUMMARY OF THE INVENTION

This invention provides a hinge assembly for rotatably mounting a vehicle door to a vehicle body structure. The hinge assembly has a movable hinge strap mounted to the vehicle door. A stationary hinge strap is mounted to the vehicle body structure and has a roller assembly. A hinge pin pivotally connects the hinge straps for rotatable movement of the door between an open position and a closed position. A curved detent link is carried by the movable hinge strap and has a pair of ends with each end having a hole. The detent link has a scalloped engagement edge with an open position indentation and a closed position indentation, with the indentations engageable with the roller assembly for positioning the door in the open position and the closed position. A pair of rivets with each rivet protruding from the movable hinges strap and received by one of the holes of the detent link for mounting the detent link to the movable hinge strap. Elastomeric fillers are interposed between each of the rivets and the curved detent link connecting each of the ends of the curved detent link to the movable hinge strap for allowing lateral movement of the detent link. The engagement of the closed position indentation of the scalloped engagement edge of the detent link by the roller holds the door in the closed position and the elastomeric fillers flex allowing movement of the detent link relative to the roller for moving the door to the open position where the roller engages the open position indentation.

One object, feature and provision is a hinge assembly having a detent link with ends having elastomeric fillers for connecting the detent link to one of the hinge straps for allowing lateral movement of the detent link while biasing the detent link into engagement with a roller to hold the door hinge in specified positions.

Further objects, features and advantages of the present invention will become more apparent to those skilled in the art as the nature of the invention is better understood from the accompanying drawings and detailed description.

DESCRIPTION OF THE PREFERRED EMBODIMENT

Figure 1:
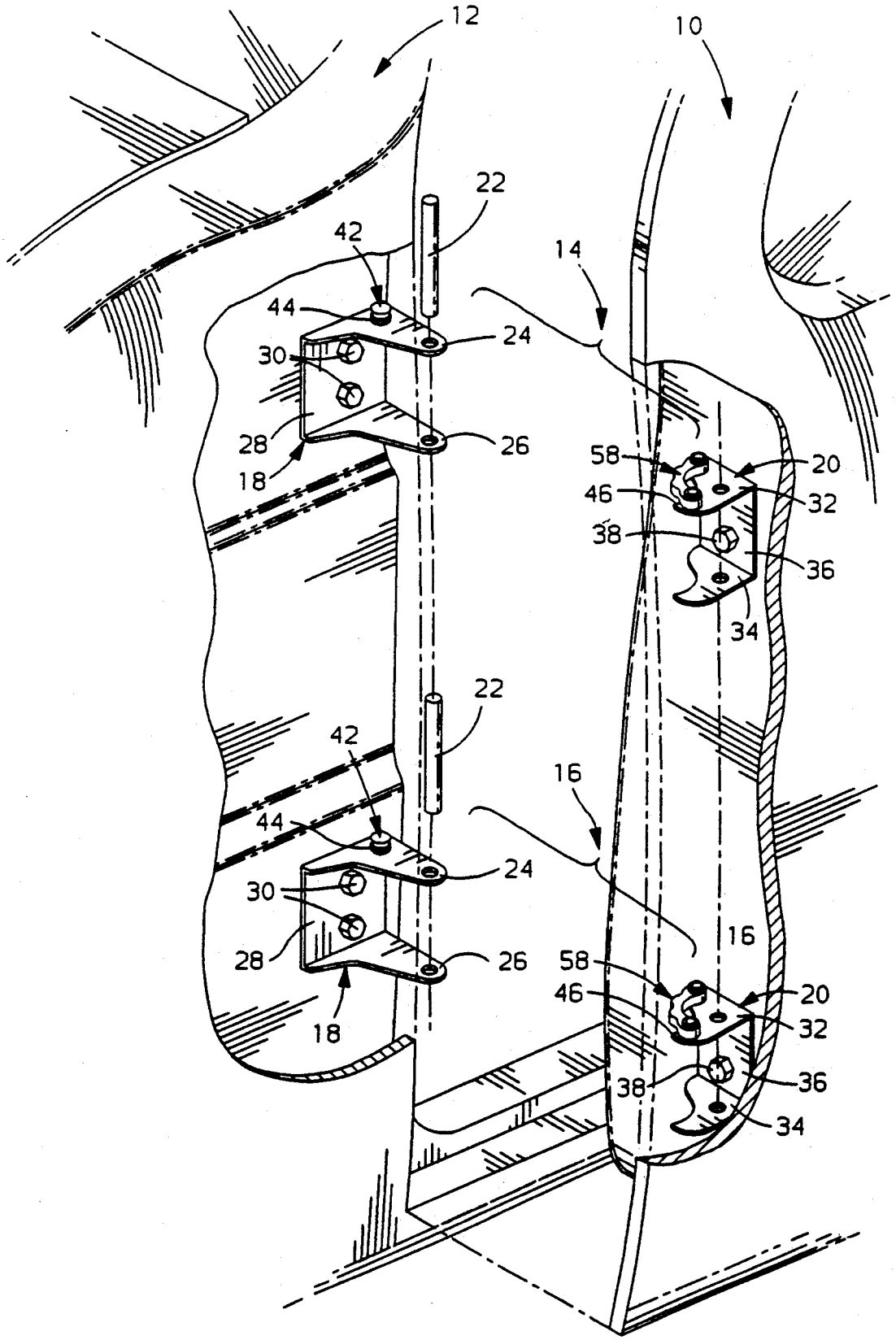
FIG. 1 is an exploded view of the hinge assembly of the invention mounted on a vehicle body and door structure.

Referring to FIG. 1, a vehicle door 10 is mounted to a vehicle body structure 12 by a pair of hinge assemblies 14 and 16 for rotation of the door 10 between a closed position and an open position. Hinge assembly 14 has a pair of U-shaped hinge straps 18 and 20 pivotally connected by a hinge pin 22. The U-shaped stationary hinge strap 18 has a pair of hinge arms 24 and 26 spaced by a mounting plate 28, where the mounting plate 28 is secured to the body structure 12 by a pair of bolts 30. A pair of hinge arms 32 and 34 of the U-shaped movable hinge strap 20 straddle the hinge arms 24 and 26 of the stationary hinge strap 18 and are pivotably connected to them by the hinge pin 22, with the hinge arms 32 and 34 of the movable hinge strap 20 spaced by a mounting plate 36. The mounting plate 36 of the movable hinge strap 20 is secured to the door 10 by a pair of bolts 38.

Figure 2:
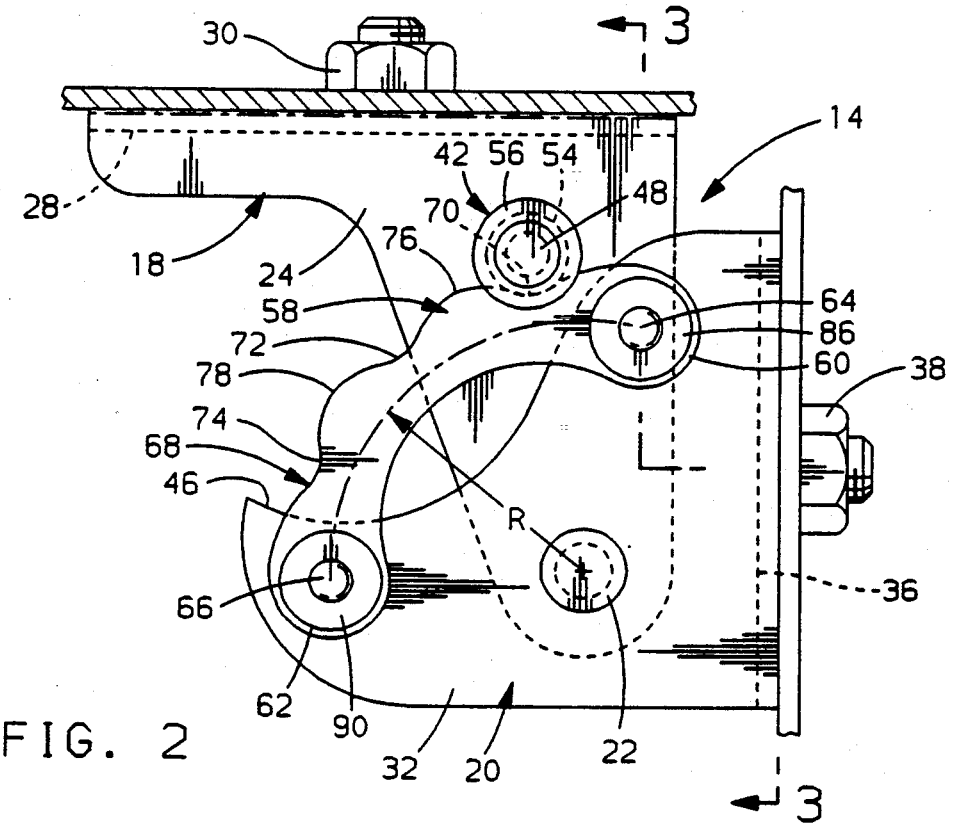
FIG. 2 is a plan view of the hinge assembly.
Figure 3:
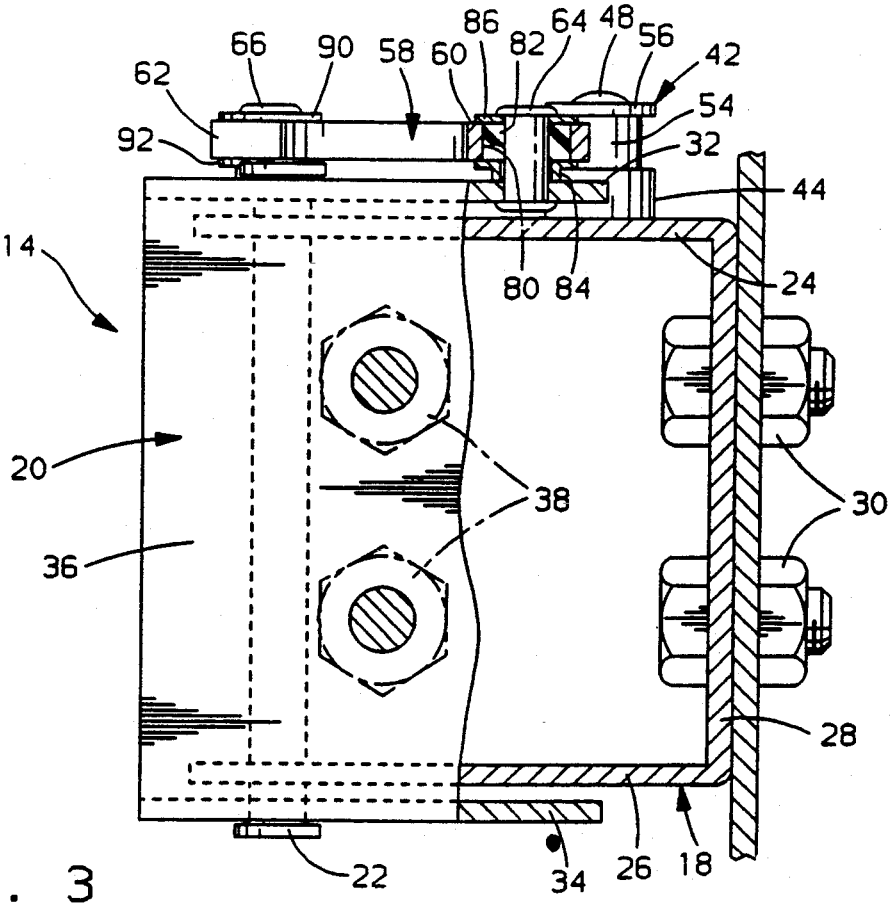
FIG. 3 is a sectional view taken in the direction of arrows 3—3 in FIG. 2 of the hinge assembly.

Referring to FIG. 3, a roller assembly 42 protrudes upward from the hinge arm 24 of the stationary hinge strap 18 and has a stop surface 44 which engages a stop edge 46 on the hinge arm 32 of the movable hinge strap 20 for limiting rotation of the the door 10 beyond the open position. Referring to FIG. 2, a pin 48 projects upward on the roller assembly 42 to receive a recess roller 54 and a washer 56. The pin 48 is peened rotatably mounting the recess roller 54.

Referring to FIG. 2, a curved detent link 58, generally located with a radius of curvature R about the hinge pin 22, has a pair of ends 60 and 62 carried on the movable hinge strap 20 by a pair of rivets 64 and 66. A scalloped edge 68 of the detent link 58, with a triplet of indentations 70, 72 and 74, and a pair of intervening peaks 76 and 78, engages the roller 54 of the roller assembly 42 for locating the door in the closed position, a partially open position and the fully open position. FIG. 2 shows the roller assembly 42 engaged by the closed position indentation 70.

Referring to FIG. 3, the end 60 of the detent link 58 has a hole 80 which receives rivet 64 and an elastomeric filler 82 to connect the detent link 58 to the movable hinge strap 20. The elastomeric filler 82 is ring shaped and interposed between the rivet 64 and the detent link 58 for resilient deflection allowing the detent link 58 to move laterally, but urging the detent link 58 towards a neutral position, where one of the indentations engages the roller 54 of the roller assembly 42. A spacer 84, which encircles the rivet 64 and spaces the detent link 58 from the movable hinge strap 20, underlies the hole 80 for restraining resilient deflection of the elastomeric filler 82 in the downward axial direction. A washer 86, which encircles the rivet 64 and spaces the detent link 58 from the head of the rivet 64, overlies the hole 80 for restraining resilient deflection of the elastomeric filler 82 in the upward axial direction. End 62 of the detent link 58 similarly has an elastomeric filler, not shown, located between the rivet 66 and the detent link 58 with a washer 90 and a spacer 92 limiting the resilient axial deflection of the elastomeric filler.

When the door 10 is being opened, the movable hinge strap 20 rotates about the hinge pin 22 from the closed position shown in FIGS. 2 and 3, with the scalloped edge 68 of the detent link 58 slideably following the roller 54. The engagement of the scalloped edge 68 with the roller 54 causes the detent link 58 to shifted towards the hinge pin 22 with the elastomeric fillers 82 deflecting, allowing the peak 76 of the scalloped edge 58 to engageably slide past the roller 54. As the peak 76 moves past the roller 54, the elastomeric fillers 82 resiliently urge the detent link 58 back towards the neutral position with the scalloped edge 68 continuing to slideably engageably follow the roller 54. When one of the indentations 72 and 74 aligns with the roller 54, the elastomeric fillers 82 hold the indentation in engagement with the roller 54 to hold the door 10 in the partially open position, or the open position. When the door 10 is in the open position, the stop edge 46 of the movable hinge strap 20 abuts the stop surface 44 of the roller assembly 42.

To move the door 10 from this position, similar to above, the movable hinge strap 20 is rotated about the hinge pin 22 with the slideable engagement of the scalloped edge 58 with the roller 54 causing the elastomeric fillers 82 to deflect allowing the peak to slide past the roller 54. Then, the elastomeric fillers 82 resiliently urge the detent link 58 back towards the neutral position holding one of the indentations in engagement with the roller 54.

If the hinge pin 22 is removed, allowing the separation of the movable hinge strap 20 and the door 10 from the stationary hinge strap 18 and the vehicle body structure 12, the detent link 58 is held at both ends 60 and 62 and the elastomeric fillers 82 place the detent link 58 in the neutral position.

Hinge assembly 16 is identical to hinge assembly 14. However, typically two detent links are not required for a single door.

While an embodiment of the present invention has been explained, various modifications within the spirit and scope of the following claims will be readily apparent to those skilled in the art. For example, the detent link could be shaped where the indentations are not equidistant from the hinge pin, and therefore, the effort to slide the peaks past the roller surface would vary because of varying deflection required in the elastomeric filler.

The elastomeric filler 82 is shown engaging the detent link 58, the rivet 64, the spacer 84 and the washer 86 thereby filling the hole 80 in the detent link 58. The ringed shaped elastomeric filler 82 could have a large center opening or not as thick thereby not constantly engaging the rivet or both the spacer 82 and the washer 86 thereby changing the deflection characteristics of the filler 82 and the associated movement of the detent link 58. In addition, the durometer of the elastomeric filler 82 could be changed, also changing the deflection characteristics of the filler 82 and the associated movement of the detent link 58. The roller assembly 42 could be one piece where the roller 54 would not rotate and the scalloped edge of the detent link would simply slide along the roller assembly. Furthermore, the location of the roller assembly 42 from the detent link 58 would affect whether the elastomeric filler 82 is in a neutral position or urging the detent link 58 towards the roller assembly 42 when one of the indentations engages the roller 54.

The embodiments of the invention in which an exclusive property or privilege is claimed are defined as follows:

1. A hinge assembly comprising:

a pair of hinge straps;

a hinge pin pivotally connecting the hinge straps;

a follower located on one of the hinge straps;

a detent link carried by the other hinge strap and having an edge for engaging the follower for positioning the hinge straps relative to each other; and pair of resilient means mounting the detent link on the other hinge strap for resilient deflection whereby the engagement of the edge of the detent link with the follower holds the hinge assembly in a position and the resilient means resiliently deflects allowing for relative movement between the follower and the edge of the detent link for changing the relative position of the hinge straps to each other and then holding the hinge straps in a new position.

2. A hinge assembly for rotatably mounting a vehicle door to a vehicle body structure, the hinge assembly comprising:

a first hinge strap mounted to the vehicle door;

a second hinge strap mounted to the vehicle body structure;

a hinge pin pivotally connecting the hinge straps;

one of the hinge straps having a roller assembly;

a detent link carried by the other hinge strap and having a pair of ends with each end having a hole and the detent link having an engagement edge with a plurality of indentations for engaging the roller assembly for positioning the hinge straps relative to each other; and a pair of elastomeric fillers, one of the elastomeric fillers located in each of the holes in the detent link for connecting the detent link to the other hinge strap for allowing resilient movement of the detent link whereby the engagement of one of the indentations of the engagement edge of the detent link with the roller holds the hinge straps in a relative pivotal position to each other and the elastomeric fillers resiliently flex allowing movement of the detent link relative to the roller to another of the indentations for changing the relative pivotal position of the hinge straps and holding the hinge straps in a new position.

3. A hinge assembly for rotatably mounting a vehicle door to a vehicle body structure, the hinge assembly comprising:

a movable hinge strap mounted to the vehicle door;

a stationary hinge strap mounted to the vehicle body structure and having a roller assembly;

a hinge pin pivotally connecting the hinge straps for rotatable movement of the door between an open position and a closed position;

a curved detent link carried by the movable hinge strap and having a pair of ends with each end having a hole and the detent link having a scalloped engagement edge with an open position indentation and a closed position indentation with the indentations engageable with the roller assembly for positioning the door in the open position and the closed position;

a pair of rivets, each rivet protruding from the movable hinges strap and received by one of the holes of the detent link for mounting the detent link to the movable hinge strap; and a pair of ringed shaped elastomeric fillers, one of the elastomeric fillers located in each hole and interposed between the rivets and the curved detent link for connecting each of the ends of the curved detent link to the movable hinge strap allowing lateral movement of the detent link whereby the engagement of the closed position indentation of the scalloped engagement edge of the detent link by the roller holds the door in the closed position and the elastomeric fillers flex allowing movement of the detent link relative to the roller for moving the door to the open position where the roller engages the open position indentation.

4. A hinge assembly as in claim 3 wherein the scalloped engagement edge of the curved detent link has at least one indentation between the open position indentation and the closed position indentation.

5. A hinge assembly as in claim 3 wherein the curved detent link has a radius of curvature about the hinge pin.

6. A hinge assembly as in claim 3 wherein the rivet, a washer and a spacer engage and retain the elastomeric filler in the hole of the detent link limiting the axial resilient deflection.

* * * * *